US010807116B2

(12) United States Patent
Ferrara

(10) Patent No.: US 10,807,116 B2
(45) Date of Patent: Oct. 20, 2020

(54) PAINTING PLANT

(71) Applicant: Salvatore Ferrara, La Cassa (IT)

(72) Inventor: Salvatore Ferrara, La Cassa (IT)

(73) Assignee: Salvatore Ferrara, La Cassa (IT)

( * ) Notice: Subject to any disclaimer, the term of this patent is extended or adjusted under 35 U.S.C. 154(b) by 372 days.

(21) Appl. No.: 15/410,325

(22) Filed: Jan. 19, 2017

(65) Prior Publication Data

US 2017/0209890 A1 Jul. 27, 2017

(30) Foreign Application Priority Data

Jan. 21, 2016 (IT) ..... 102016000005879

(51) Int. Cl.

| | |
|---|---|
| ***B05B 16/00*** | (2018.01) |
| ***B05B 16/60*** | (2018.01) |
| ***B05B 1/24*** | (2006.01) |
| *B05B 14/43* | (2018.01) |
| *B05B 16/80* | (2018.01) |

(52) U.S. Cl.

CPC ..... *B05B 16/00* (2018.02); *B05B 1/24* (2013.01); *B05B 16/60* (2018.02); *B05B 14/43* (2018.02); *B05B 16/80* (2018.02)

(58) Field of Classification Search

CPC B05B 16/00; B05B 1/24; B05B 12/16; B05B 16/60; B05B 16/80; B05B 14/43

See application file for complete search history.

(56) References Cited

U.S. PATENT DOCUMENTS 2,250,260 A * 7/1941 Fowler ..... B05B 16/95 95/16
2,761,373 A * 9/1956 Owen ..... B05B 16/80 454/55

(Continued)

FOREIGN PATENT DOCUMENTS

FR 2692028 A1 12/1993
GB 2 450 231 A 12/2008

(Continued)

OTHER PUBLICATIONS

Tanaka et al., Operating Method for Water Paint Coating Booth, Dec. 4, 1989, JPH01299672A, Whole Document (Year: 1989).*

(Continued)

*Primary Examiner* — Larry L Furdge
(74) *Attorney, Agent, or Firm* — MH2 Technology Law Group, LLP

(57) ABSTRACT

A painting plant with a painting booth defining inside a substantially closed work environment, an air admitting and extracting system, a control unit with a data entering system and a data storing memory; a humidity sensor in the painting booth, for sending to the control unit a signal indicative of the humidity; a fresh air intake conduit comprises a heating section with a heater for heating the air to be delivered to the painting booth, and a humidifying section having a humidifier for humidifying the air to be delivered to the painting booth; the control unit is configured for receiving a set value of the humidity inside the painting booth, receiving the signal indicative of a humidity inside the painting booth, adjusting the humidifier based on the set value and of the humidity indicative signal inside the booth.

20 Claims, 7 Drawing Sheets

(56) References Cited

U.S. PATENT DOCUMENTS

| | | | | | |
|---|---|---|---|---|---|
| 4,499,031 | A * | 2/1985 | Sexton | B01F 3/04085 236/44 C |
| 5,213,259 | A | 5/1993 | Stouffer | |
| 5,836,085 | A * | 11/1998 | Ben-Ezra | F26B 3/305 34/270 |
| 2002/0129614 | A1 * | 9/2002 | Dinnage | F24F 3/1423 62/271 |
| 2007/0017233 | A1 * | 1/2007 | Hawkins | F25D 13/067 62/63 |
| 2008/0311836 | A1 * | 12/2008 | Bhattacharya | B05B 12/08 454/52 |
| 2013/0171920 | A1 | 7/2013 | Bhattacharya | |

FOREIGN PATENT DOCUMENTS

| | | | | |
|---|---|---|---|---|
| JP | H01299672 | A | * | 12/1989 |
| JP | 2002147800 | A | * | 5/2002 |
| JP | 3174838 | U | * | 4/2012 |

OTHER PUBLICATIONS

Ueno, Paint Booth, Apr. 12, 2012, JP3174838U, Whole Document (Year: 2012).*

Mizuta, Air Conditioner, Feb. 22, 2002, JP2002147800A, Whole Document (Year: 2002).*

Sep. 27, 2016 Search Report issued in Italian Application No. ITUB20160399.

* cited by examiner

PAINTING PLANT

FIELD OF THE INVENTION

The present invention relates to a painting plant, particularly for body-shops.

BACKGROUND OF THE INVENTION

The body-shops for repairing vehicles are usually provided with a plurality of work stations in which repair operations are executed, such as removal of the body parts or of damaged mechanical parts, mounting of body panels or repaired or replaced mechanical components, etc. After the repair operations have been carried out, the vehicle is transferred into a painting booth in which the painting and drying operations are carried out. In the painting booth, a system must be provided for extracting polluted air and for admitting fresh air, in order to prevent the contamination of the work environment by the sprayed paints.

In the body-shops of conventional type, the painting booths are stationary and the vehicles are moved between the repair stations and the painting booths. The movements of the vehicles inside a body-shop involve a considerable expenditure of time.

The document WO2012/085535 describes a movable painting booth that forms a controlled environment for the spraying operations. The painting booth is mounted on a support track and is movable along the track in order to be positioned at different work stations. This solution allows reducing the number of vehicle movements inside the body-shop. Indeed, the vehicles to be repaired are positioned in respective work stations where the repair operations are carried out. After having completed the repair operations, the booth is positioned on the work station without moving the vehicle. The movable painting booth described in the document WO2012/085535 comprises a ventilation system arranged on the roof of the booth which draws a flow of air from the environment inside the body-shop and sends it inside the painting booth and extracts a flow of polluted air from the painting booth, which is introduced into the internal environment of the garage after a filtering.

One of the main problems of the solution known from the document WO2012/085535 is that the air admitting and extracting system of the painting booth is not in accordance with the norms, which state that the change of air inside the painting booths must be carried out with air drawn from outside the building. In addition, the air admitting and extracting system described in this document is not able to ensure an effective change of air inside the painting booth since the extraction and the withdrawing of air occur at the upper wall of the painting booth, so that it is probable that during use a part of the fresh air flow is recirculated towards the discharge system without carrying out an effective change of air inside the painting booth.

In addition, known painting booths are affected by the problem given by the possibility of static current formation, which exponentially increases during the winter, during which it is necessary to proceed with the heating of the booth in order to create work conditions that are acceptable for the operator. The presence of static currents negatively affects the output of the painting.

OBJECT AND SUMMARY OF THE INVENTION

The present invention has set the object of providing a painting plant which overcomes the problems of the prior art.

In particular, one objective of the finding is to considerably reduce the formation of static currents inside the booth.

Another object of the plant in accordance with that described is to ensure an improved applicability and sprayability of latest-generation water-based painting products.

In addition to the above-described objectives, there is also the possibility to obtain a free summer air conditioning in the booth.

According to the present invention, at least one of such objects is achieved by a painting plant having the characteristics forming the object of claim 1.

The claims form an integral part of the teaching provided in relation to the invention.

Aspects of the Invention

In accordance with a 1st independent aspect, a painting plant is provided, particularly for body-shops, comprising:

- a painting booth (28) defining inside a work environment substantially closed under operative conditions,
- an air admitting and extracting system (42) associated with the painting booth (28),
- a control unit (40) associated with the painting booth and provided with a data entering system (40*a*) and a data storing memory;
- at least one sensor (105) of a parameter linked to humidity, particularly a humidity in the painting booth, configured for sending to the control unit (40) a signal indicative of a humidity inside the painting booth (28); said air admitting and extracting system (42) comprising at least one fresh air intake conduit (44) having an inlet for withdrawing air from an external environment and an outlet for admitting air in the painting booth (28) and at least one polluted air discharge conduit (46) having a respective inlet for taking away polluted air from the painting booth, said air intake (44) and air discharge (46) conduits being stationary and both communicating with an external environment under operative conditions of the painting booth, characterized in that the intake conduit (44) comprises:
  - a heating section (101) having means (102) for heating the air to be delivered to the painting booth (28); and
  - a humidifying section (103) having means (104) for humidifying the air to be delivered to the painting booth (28);

the control unit (40) being active on the humidifying means (104) and on said at least one sensor (105) and configured for:

- receiving a set value or set range of values of the humidity inside the painting booth, said set value or set range of values being pre-stored in the memory of the control unit or received by the data entering system;
- receiving the signal indicative of a humidity, particularly a humidity inside the painting booth from the sensor (105);
- adjusting the humidifying means (104) as a function of said set value or set range of values and of said humidity indicative signal.

In a 2nd aspect in accordance with the 1st aspect, the humidifying section (103) is placed downstream of the heating section (101) along an advancement direction (A) of the intake air.

In a 3rd aspect in accordance with any one of the preceding aspects, the humidifying means (104) comprise a predetermined number of evaporating panels (112) arranged in the humidifying section substantially transverse to the intake air flow direction, the intake air crossing said predetermined number of evaporating panels (112) and being humidified.

In a 4th aspect in accordance with the preceding aspect, the humidifying means (104) further comprise a transport line (113) for a fluid adapted to wet the evaporating panels, said fluid being for example water, and a valve (114) for adjusting the fluid flow rate towards the evaporating panels (112).

In a 5th aspect in accordance with the preceding aspect, the control unit (40) commands said valve (114) to increase and/or decrease the fluid flow rate, the control unit (40) being programmed for:

determining if a difference between the set value and a humidity inside the booth (28), determined by the signal coming from the sensor (105), is respectively greater or less than a predetermined threshold;

increasing the fluid flow rate if the difference is greater than the threshold; and/or decreasing the fluid flow rate if the difference is greater than the threshold.

In a 6th aspect in accordance with any one of the preceding aspects, the humidifying means (104) comprise at least one condensate and/or water drops abatement element (115) and optionally a condensate and/or water drops collection tank (116) placed below said abatement element (115).

In a 7th aspect in accordance with any one of the preceding aspects, the intake conduit (44) further comprises a thrust section (106) having at least one ventilator (117) configured for generating an air flow towards the painting booth (28), particularly said thrust section (106) being placed downstream of said humidifying section (103) and/or of said heating section (101) along an advancement direction (A) of the intake air.

In an 8th aspect in accordance with any one of the preceding aspects, the plant further comprises at least one temperature sensor (118) for supplying a signal indicative of the temperature inside the painting booth (28), the means (102) for heating the air and the temperature sensor (118) are connected to the control unit (40), the control unit being configured for:

receiving a set temperature value;

determining a temperature inside the painting booth (28);

commanding the heating means (102) as a function of said set temperature value and of said temperature value inside the booth, particularly as a function of their difference.

In a 9th aspect in accordance with any one of the preceding aspects, the air heating means (102) comprise at least one direct fire burner.

In a 10th aspect in accordance with any one of the preceding aspects, the plant further comprises at least one temperature sensor (118) for supplying a signal indicative of the temperature inside the painting booth (28), the temperature sensor (118) being connected to the control unit (40), the control unit being configured for:

receiving a set temperature value;

determining a temperature inside the painting booth (28);

commanding the humidifying means (104) as a function of said set temperature value and of said temperature value inside the booth, particularly as a function of their difference.

In an 11th aspect in accordance with the preceding aspect and with aspect 4, the control unit (40) commands said valve (114) to increase and/or decrease the fluid flow rate, the control unit (40) being programmed for:

determining if a difference between the set temperature value and the temperature inside the booth, determined by the signal coming from the temperature sensor, is respectively greater or less than a predetermined threshold;

increasing the fluid flow rate if the difference is greater than the threshold; and/or decreasing the fluid flow rate if the difference is greater than the threshold.

In a 12th aspect in accordance with the preceding aspect, the control unit (40) is further programmed for determining if the humidity in the painting booth (28) is greater than or equal to a predetermined threshold, in case the humidity in the painting booth (28) is greater than or equal to the predetermined threshold and in case the temperature inside the painting booth is greater than the set temperature value, the control unit (40) does not command any increase of the fluid flow rate.

In a 13th aspect in accordance with any one of the preceding aspects, the intake conduit (44) comprises a pre-filtration assembly (107) for the intake air, said pre-filtration assembly (107) being placed downstream of the inlet to the intake conduit (44) and upstream of the heating section (101) along an advancement direction of the intake air.

In a 14th aspect in accordance with any one of the preceding aspects, the intake conduit (44) comprises a heat exchanger (108), particularly a cross-flow static heat exchanger, said heat exchanger (108) being placed upstream of the heating section (101) along an advancement direction of the intake air, said heat exchanger (108) exchanging heat with the polluted air exiting the painting booth (28).

In a 15th aspect in accordance with any one of the preceding aspects, the intake conduit (44) comprises a by-pass passage (109) for communicating the intake conduit (44) with the polluted air discharge conduit (46) and further comprises a closure shutter (110) adapted to selectively stop a fluid flow through the by-pass passage (109), optionally the control unit being active on the closure shutter (110) for selectively commanding the movement thereof from the closed condition to the open by-pass condition, particularly during a drying operative condition in painting booth.

In a 16th aspect in accordance with any one of the preceding aspects, the intake conduit (44) comprises a shutter (111) selectively adapted to close the inlet to the intake conduit (44).

In a 17th aspect in accordance with any one of the preceding aspects, the plant comprises a platform (16) on which a plurality of work stations (18, 20, 22) are defined, each of which adapted to receive a vehicle (V), the painting booth (28) being movable on the platform (16) and positionable on each of said work stations (18, 20, 22), in which the polluted air discharge conduit (46) communicates with air intake volumes (48) placed below said platform (16), in which said fresh air intake conduit (44) has a plurality of openings (56) placed at respective work stations (18, 20, 22), and in which the intake booth (28) comprises a fresh air intake vent (58) selectively connectable to the opening (56) placed at the work station (18, 20, 22), on which the painting booth (28) is positioned.

In an 18th aspect in accordance with any one of the preceding aspects, said fresh air intake conduit (44) and said polluted air discharge conduit (46) communicate with an intake/discharge group (50) placed in the internal environment and communicating with an external environment by means of an external expulsion conduit (52) and an external intake conduit (54).

In a 19th aspect in accordance with any one of the preceding aspects, said fresh air intake conduit (44) and said polluted air discharge conduit (46) communicate with an intake/discharge group (50) placed in the external environment.

In a 20th aspect in accordance with any one of the preceding aspects, said intake mouth (58) is provided with a front seal (60) adapted to establish a sealing contact with a front wall of the fresh air intake conduit (44) around the corresponding opening (56).

In 21st aspect in accordance with the preceding aspect, said front seal (60) has a pressurizable cavity for moving the front seal (60) between a sealed position and a disengaged position.

In 22nd aspect in accordance with any one of the preceding aspects from 17 to 21, said openings (56) of said fresh air intake conduit (44) are closed by respective openable ports.

In a 23rd aspect in accordance with any one of the preceding aspects, the plant further comprises a drying system housed inside the painting booth (28), said drying system being particularly an infrared radiation technology semi-arc drying system.

In a 24th aspect in accordance with any one of the preceding aspects, the plant further comprises at least one air inflow paint gun housed inside the painting booth (28).

In a 25th aspect in accordance with any one of the preceding aspects 23 and 24, the air inflow to the paint gun is interrupted under an activation condition of the drying system.

BRIEF DESCRIPTION OF THE DRAWINGS

The present invention will now be described in detail with reference to the enclosed drawings, given merely by way of a non-limiting example, in which.

DETAILED DESCRIPTION

Figure 1:
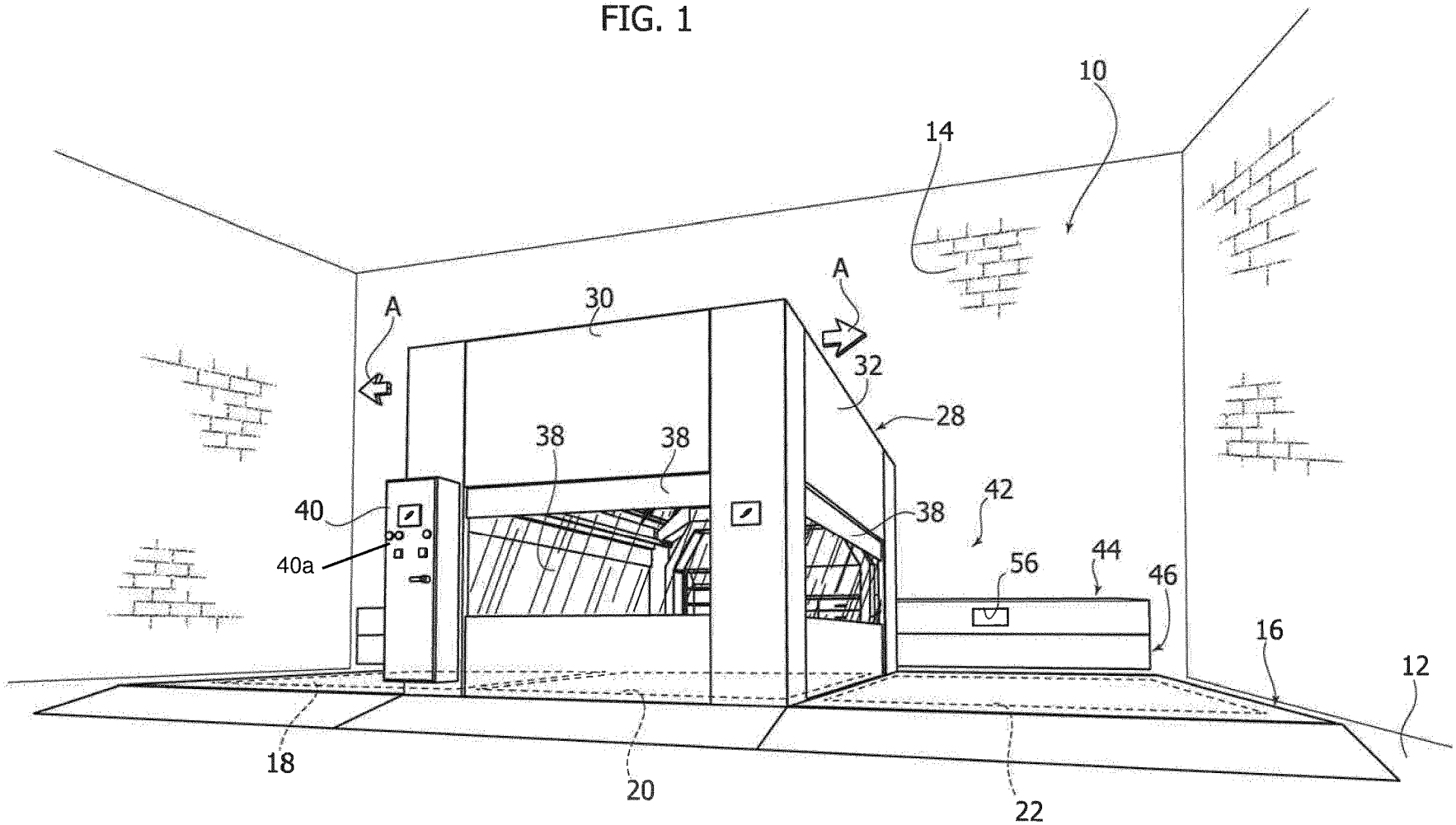
FIG. 1 is a perspective view of a painting plant according to the present invention.

With reference to FIG. 1, reference number 10 indicates a painting plant according to the present invention. The painting plant 10 is intended to be installed inside a closed building having a floor 12 and a perimeter wall 14 which divides the internal environment of the building from the outside environment.

Figure 2:
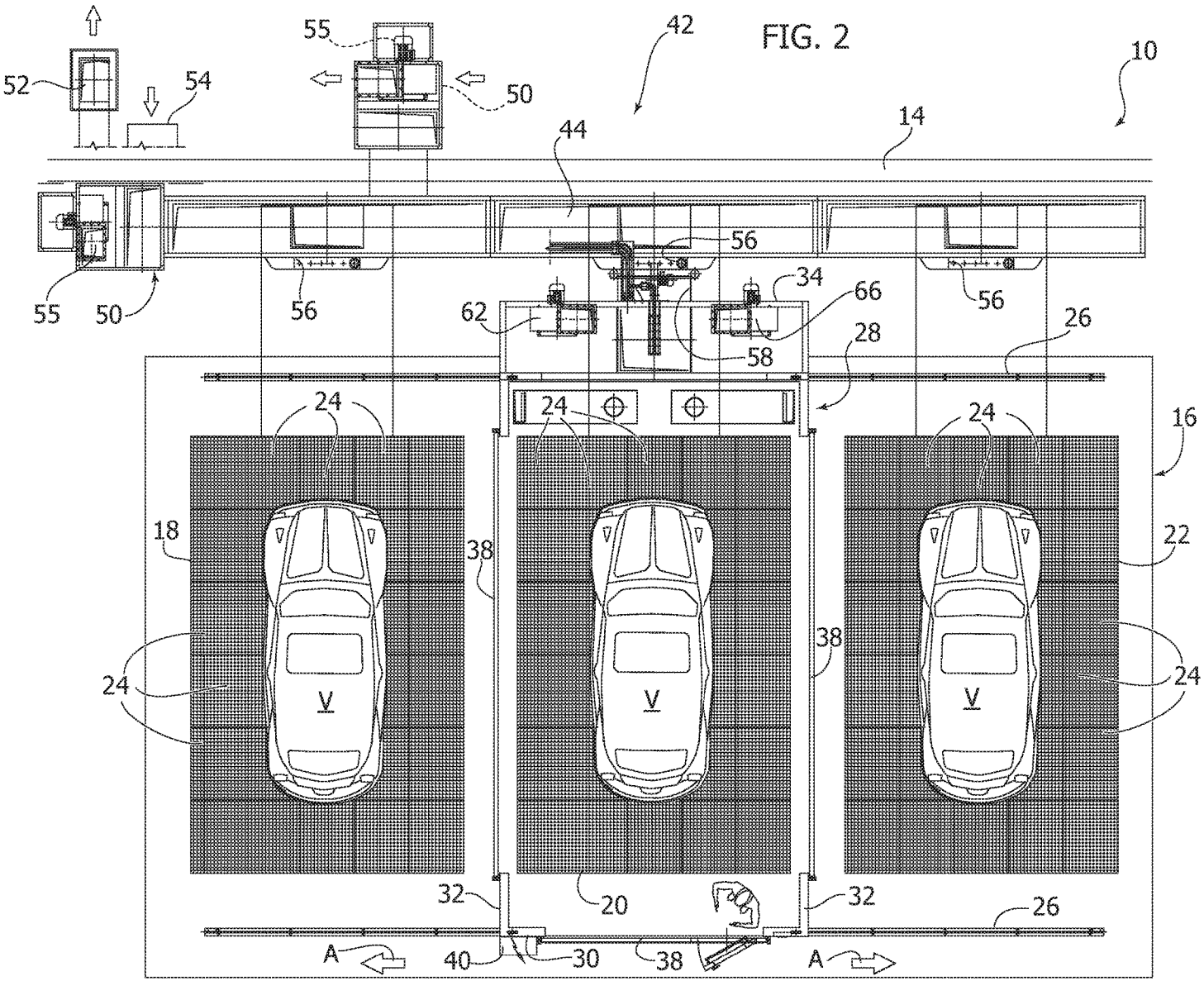
FIG. 2 is a plan view of the plant of FIG. 1.

The painting plant 10 comprises a platform 16 fixed to the floor 12, on which a plurality of work stations 18, 20, 22 are defined, each of which adapted to receive a vehicle V. In FIGS. 1 and 2, the work stations 18, 20, 22 were schematically represented with dashed-line rectangles. Three work stations parallel to each other are illustrated in the embodiment, but it is intended that the present invention can be applied to painting plants with any number or arrangement of work stations.

The platform 16 has a horizontal floor which can be slightly raised (or alternatively lowered) with respect to the floor 12 of the building. As illustrated in FIG. 2, the floor of the platform 16 can be formed by grid-like metal panels 24 at least at the work stations 18, 20, 22. Still with reference to FIG. 2, the platform 16 is equipped with two parallel rails 26 placed on opposite sides of the work areas 18, 20, 22 and with a length equal to the overall extension in a transverse direction of the work areas 18, 20, 22.

Figure 3:
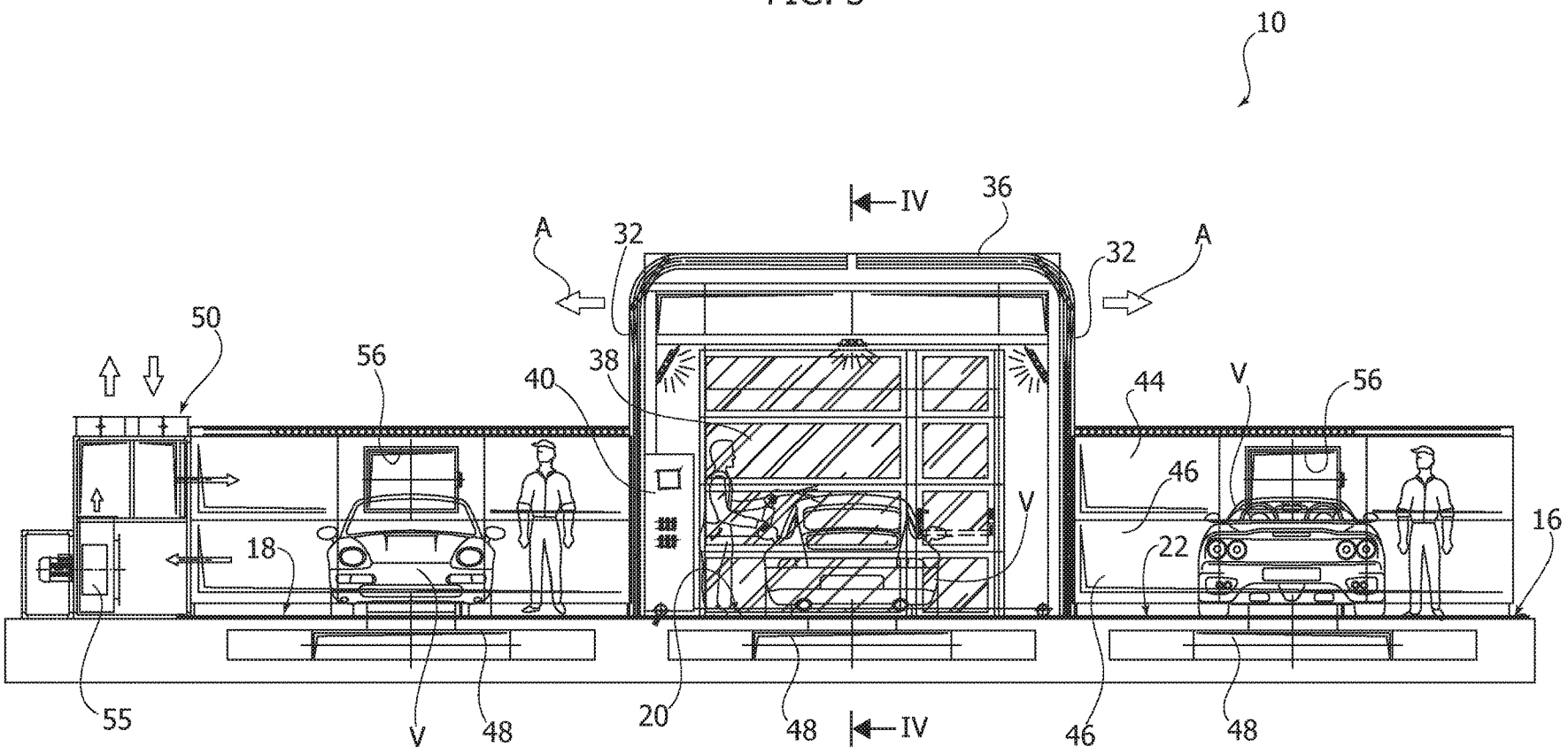
FIG. 3 is a front view of the plant of FIG. 1.
Figure 4:
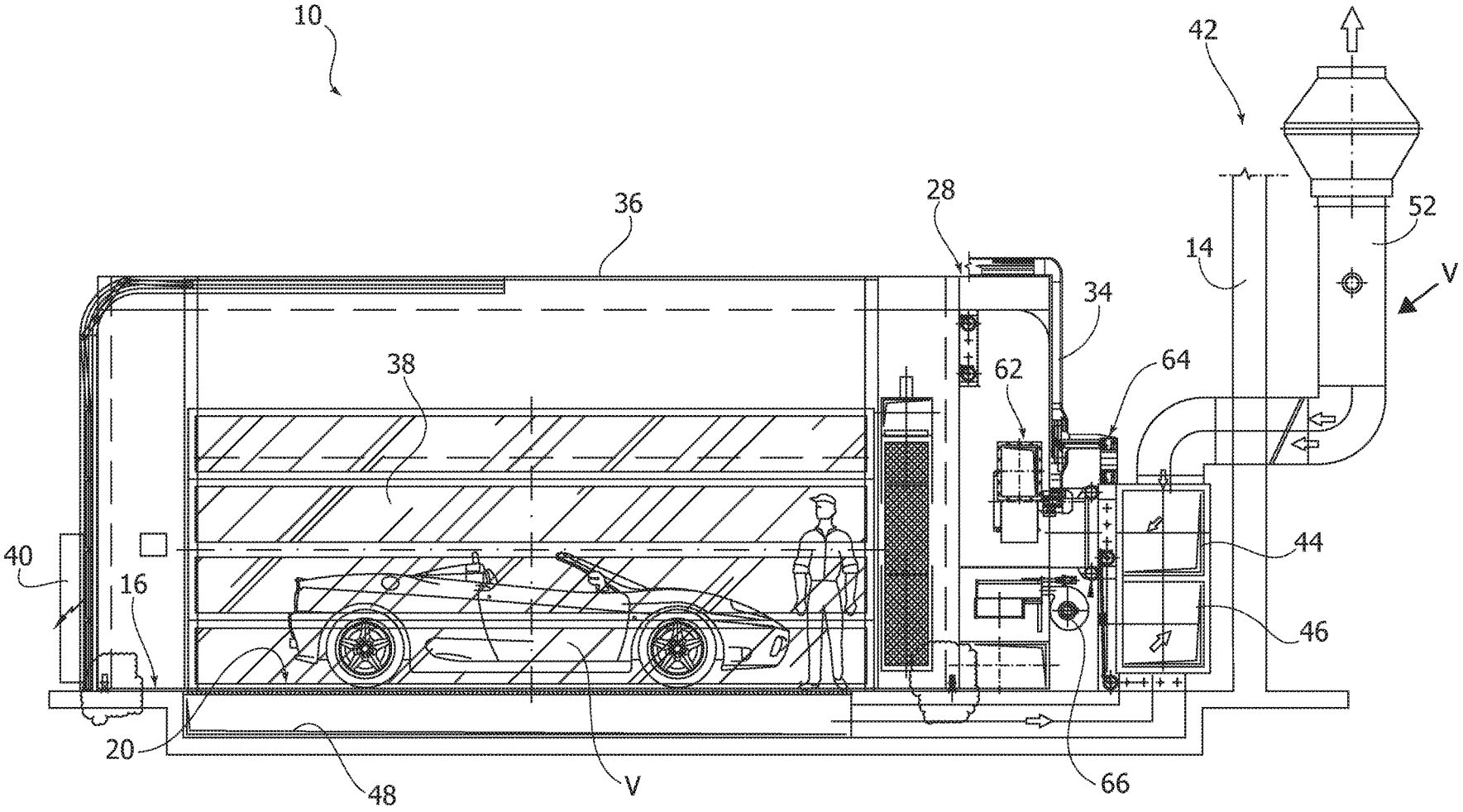
FIG. 4 is a section along line IV-IV of FIG. 3.

The painting plant 10 comprises a painting booth 28 which is provided with wheels which engage the rails 26 of the platform 16. The painting booth 28 is movable along the rails 26 in the direction indicated by the arrows A in FIGS. 1 and 3 and it is positionable on top of each of the work stations 18, 20, 22. The painting booth 28 has a substantially parallelepiped shape, with a front wall 30, two lateral walls 32, a rear wall 34 and an upper wall 36. The front part 30 and the lateral walls 32 are equipped with openings closed by vertically slidable doors 38 which can be formed by flexible cloths or by rolling shutters (or even by vertical doors of sectional type). The bottom of the painting booth 28 is closed with a wall, and the painting booth 28 with the doors 38 of the lateral walls 32 is free to be moved in transverse direction on top of the vehicles V placed on the work stations 32. Inside the painting booth 28, a drying arc is placed that is provided with heating elements and movable in longitudinal direction inside the painting booth 28 along suspended guides. The heating arc is commanded by a control unit 40 carried by the painting booth 28. The heating arc can have a structure substantially identical to that of the heating arcs of the stationary painting booths of known type.

The painting plant 10 comprises an air admitting and extracting system 42 adapted to carry out a change of air inside the painting booth 28 in any position of the painting booth 28. The air admitting and extracting system 42 comprises a fresh air intake conduit 44 and a polluted air discharge conduit 46 both communicating with outside the building where the painting plant 10 is installed. In the embodiment illustrated in the figures, the fresh air intake conduit 44 and the polluted air discharge conduit 46 are rectilinear conduits of bent sheet metal with square cross section, which are extended on top of each other parallel to the movement direction of the painting booth 28 on the internal side of the perimeter wall 14. It is naturally intended that the conduits 44, 46 can have any shape and can be arranged in any manner, not necessarily parallel to the movement direction of the painting booth 28.

The polluted air discharge conduit 46 communicates with intake volumes of polluted air 48 placed below the work stations 18, 20, 22, and in communication with the internal environment of the building by means of the perforated surfaces of the grid-like metal panels 24 forming the floor of the platform 16. Filtering material can be arranged in the intake volumes of polluted air 48. The air admitting and extracting system 42 comprises an intake/discharge group 50 formed by a metal casing placed on the internal side of the perimeter wall 14 at one end of the conduits 44, 46. Alternatively, the intake/discharge group 50 can be arranged on the external side of the perimeter wall 14 in any position on the length of the conduits 44, 46. In FIG. 2, a solid line indicates the intake/discharge group 50 arranged inside the building and a dashed line indicates the intake/discharge group arranged outside. When the intake/discharge group 50 is placed inside the building, it communicates with the outside by means of an external expulsion conduit 52 and an external intake conduit 54 which are extended through the perimeter wall 14. If the intake/discharge group 50 is placed outside, it communicates with the fresh air intake conduit 44 and with the polluted air discharge conduit 46 by means of conduit sections that are extended through the perimeter wall 14. The intake/discharge group 50 contains a discharge ventilator 55 that suctions an air flow from the polluted air discharge conduit 44 and sends it into the external environment. The intake/discharge group 50 can also be equipped with filters for the fresh air flow coming from the outside.

The fresh air intake conduit 44 communicates with the outside environment by means of the intake/discharge group 50. The fresh air intake conduit 44 has a plurality of openings 56 placed at respective work stations 18, 20, 22. The openings 56 are preferably closed by respective openable ports. The openable ports associated with the openings 56 can be opened manually or by means of motorized devices.

Figure 5:
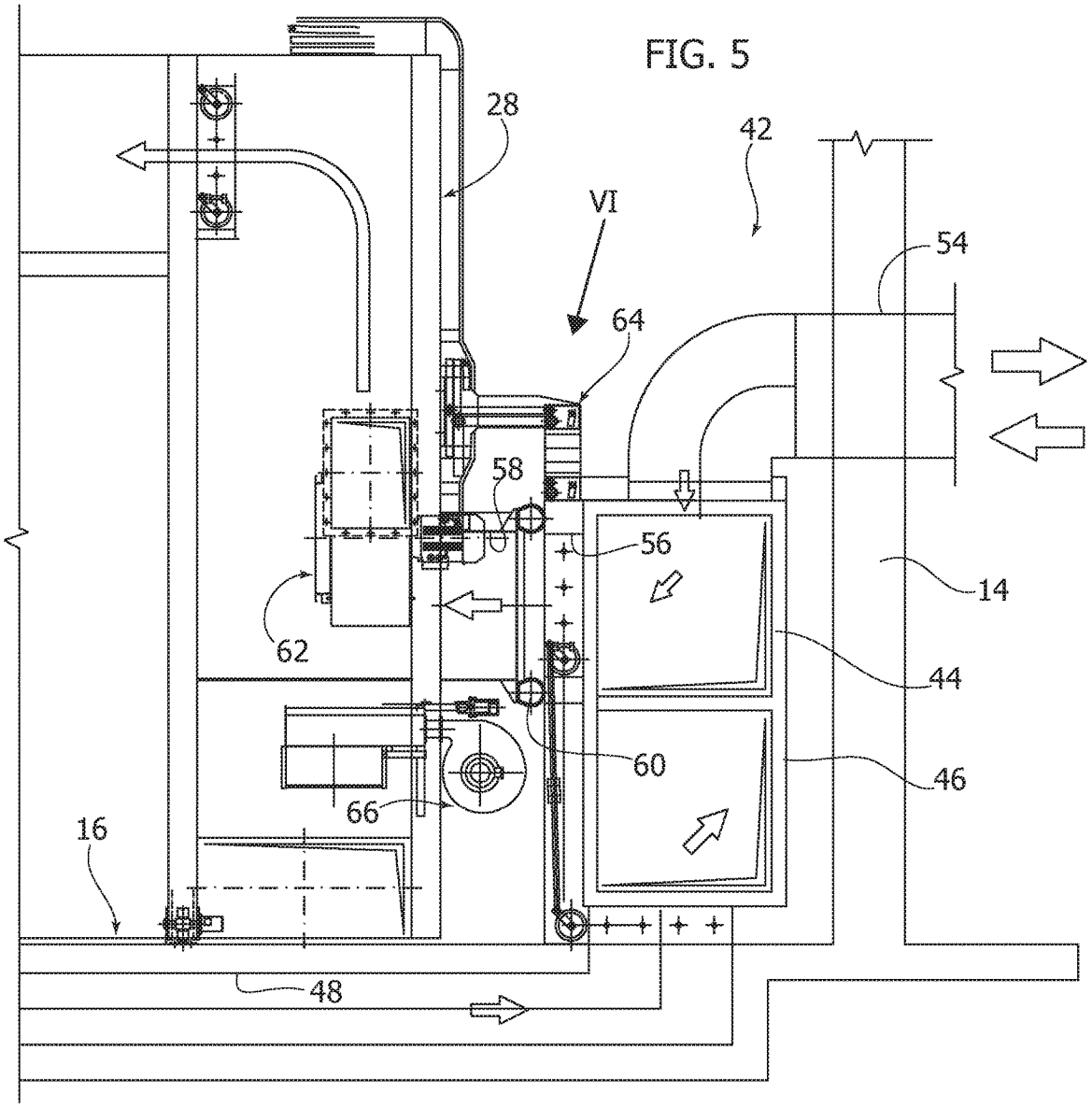
FIG. 5 is a view in enlarged scale of the part indicated by the arrow V in FIG. 4.
Figure 6:
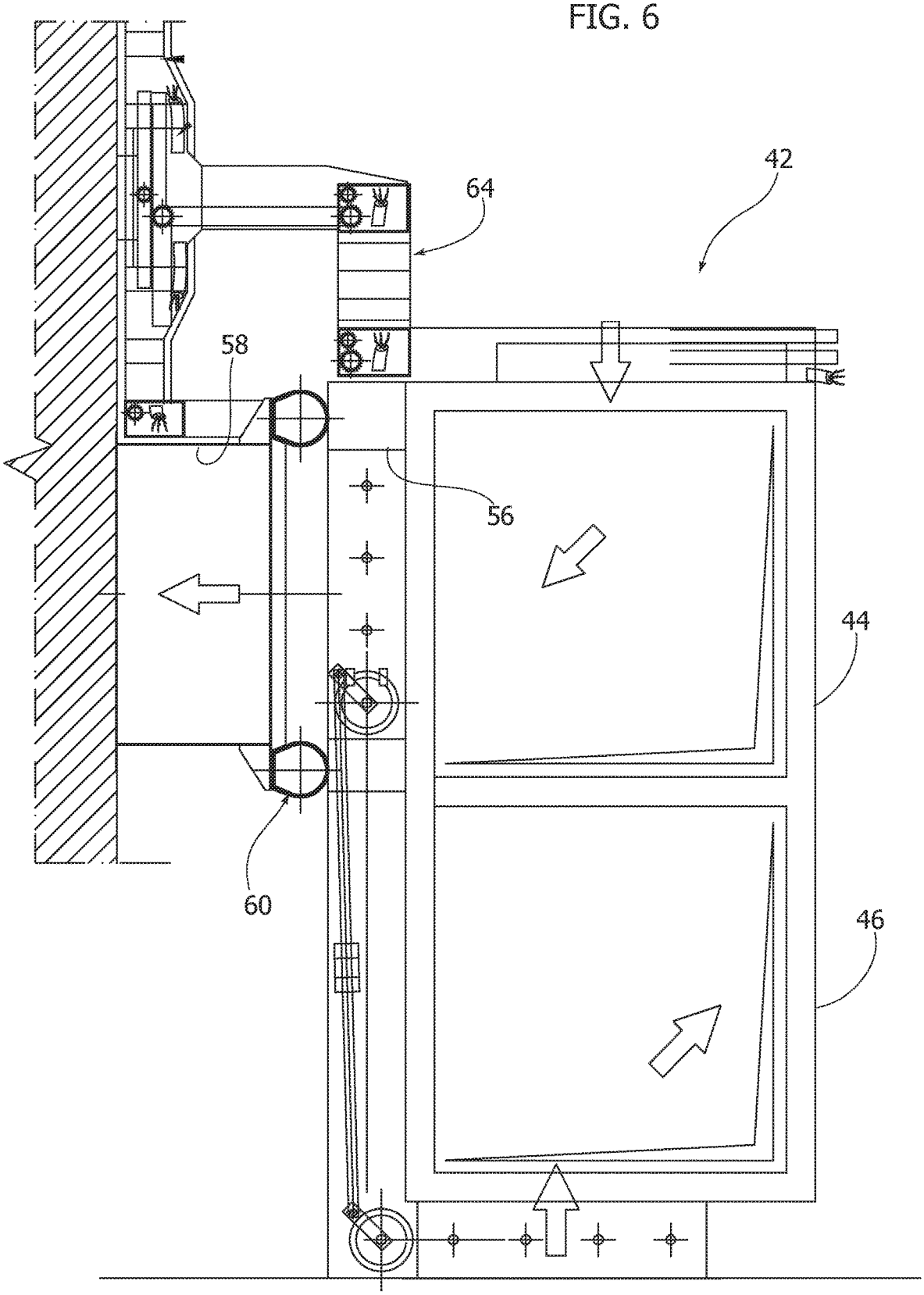
FIG. 6 is a detail in enlarged scale of the part indicated by the arrow VI in FIG. 5.

With reference particularly to FIGS. 5 and 6, the painting booth 28 comprises an intake mouth 58 selectively connectable to the opening 56 placed at the work station 18, 20, 22 on which the painting booth 28 is positioned. The intake mouth 58 of the painting booth 28 frontally faces a respective opening 56 of the fresh air intake conduit 44 following the movement in transverse direction of the painting booth 28. When the painting booth 28 is correctly positioned on a respective work station 18, 20, 22, the intake mouth 58 frontally faces the opening 56 placed at the respective work station 18, 20, 22. The intake mouth 58 is equipped with a front seal 60 which establishes a sealing contact with the front wall of the fresh air intake conduit 44 around the opening 56. The front seal 60 surrounds the front side of the intake mouth 58 and is formed by an internally hollow ring that can be pressurized with compressed air (or alternatively by a bellows extensible via pneumatic cylinders) and with sealing gasket. When the front seal 60 is not pressurized, there is a clearance of several centimeters between the front seal 60 and the front wall of the fresh air intake conduit 44. In pressurized conditions, the front seal is pressed against the front wall of the fresh air intake conduit 44. The front seal 60 can for example have a thickness of 40 mm in non-pressurized condition and a thickness of 100 mm in pressurized condition. The feed pressure of the front seal can for example be 0.4/bar and comes from the compressed air feed circuit of the painting booth 28.

The painting booth 28 carries a fresh air delivery ventilator 62 which draws a fresh air flow from the intake mouth 58 and sends it to a fresh air distribution system placed inside the painting booth 28.

In a preferred embodiment, an air treatment unit is provided at the inlet to the painting booth which is positioned, for example, alongside or behind the painting booth 28 itself and is connected by means of conduits to the rear air distribution/extraction manifold described above.

Figure 7:
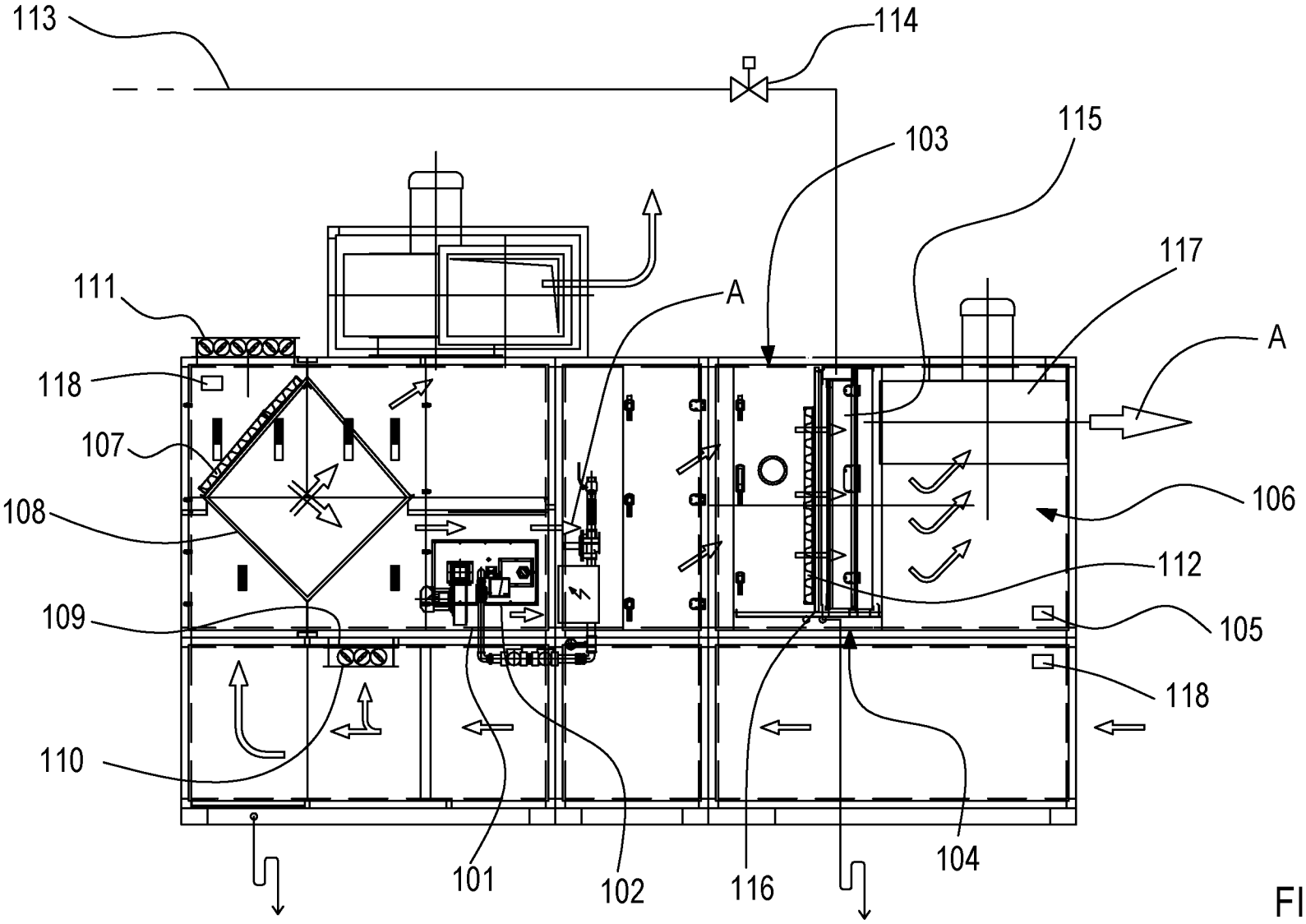
FIG. 7 illustrates, in side view, a treatment unit of the air entering the painting booth.

In its exemplifying but non-limiting form, shown in FIG. 7, the air treatment unit is constituted by a compact and self-supporting single-block group, provided with an external casing constituted by paneling that is entirely thermally and acoustically insulated with insulation (e.g. made of class 0 fire-resistant mineral wool). Such unit can be installed on the edge of the booth, or it can be a "remote" thermal group also positionable outside the room where the painting booth is situated.

Observing FIG. 7, it is noted that the treatment unit, which is part of the abovementioned fresh air intake conduit 44, first of all comprises an inlet for withdrawing air from an external environment. A shutter 111 is selectively adapted to close the inlet to the intake conduit 44. The movement of the shutter 11 can be manual (moved by an operator), or it can be driven by a motor commanded by the control unit 40. Continuing along the advancement direction A of the intake air, the fresh air coming from the external environment encounters a pre-filtration assembly 107 comprising a series of filter elements (e.g. modular filter panels), particularly with filtration class EU4.

Downstream, a heat exchanger 108 is present, particularly a cross-flow static heat exchanger, which, by transferring sensitive heat from the expulsion air side, supplies a first preheating of the air at the inlet, thus ensuring high energy savings. In other words, the heat exchanger 108 exchanges heat with the polluted air exiting the painting booth 28, increasing the energy efficiency of the system.

The air exiting from the exchanger 108 reaches a heating section 101 provided with suitable means 102 for heating the air to be delivered to the painting booth 28. In the preferred embodiment, the air heating means 102 comprise at least one direct fire burner with modulating operation that can be fed with methane gas or LPG having potential up to 250 kW. It should be indicated that the heating section is automatically activated according to the temperature requirement in the painting booth 28 as a function of the air temperature at the inlet and of the temperature required in the booth, e.g. set by the operator.

For such purpose, the control unit 40 can receive, in input from the operator, a desired temperature in the painting booth 28 (set temperature). A temperature sensor 118 can measure the temperature of the air at the inlet to the temperature unit or even an actual temperature in the painting booth or in proximity thereto and as a function of the reading and of the set activate or not activate the burner in order to obtain the optimal temperature conditions in the painting booth 28.

In the illustrated figures, the temperature sensor 118 was positioned in different locations, all possibly usable. Of course, only one temperature sensor may be sufficient, though more than one could in any case be used.

In a specific configuration, the control unit is configured or programmed for receiving a set temperature value (set for example by the operator), for determining the temperature inside the painting booth 28 and for commanding the heating means 102 as a function of said set temperature value and of said temperature value inside the booth, particularly as a function of their difference, so as to reach the desired temperature in the painting booth. Of course, instead of the temperature in the painting booth, the control unit 40 could use the temperature of the intake air in order to establish the extent of the heating required for the flow.

From the heating section 101, the air passes to the humidification station 103, inside which means 104 are present for humidifying the air to be delivered to the painting booth 28. In detail, the humidifying section 103 is placed downstream of the heating section 101 along an advancement direction A of the intake air and the humidifying means 104 have a predetermined number of evaporating panels 112 arranged substantially transverse to the direction A of the intake air flow, i.e. the intake air crosses the evaporating panels 112 and is humidified. Evaporation packs of self-extinguishing adiabatic type are used.

The operation of the evaporating panel occurs by means of a natural process, i.e. the exchange of energy between water and air. Particularly, a transport line 113 is present for a fluid adapted to wet the evaporating panels (the fluid will generally be water) and a valve 114 is present for adjusting the fluid flow rate towards the evaporating panels 112.

The pumping system placed at the top of the panel(s) uniformly wets the pack surface. When the water flows inside the humidifying pack, the energy necessary for the evaporation of the water is drawn from the air that crosses the panels themselves. The air present in the panels supplies the heat necessary for the water evaporation process, therefore the exiting air is cooled and above all humidified.

The humidifying means 104 comprise at least one condensate and/or water drops abatement element 115 and a condensate and/or water drops collection tank 116 placed below said abatement element 115.

The humidifying section 103, comprising the above-described self-extinguishing adiabatic evaporation pack, fed with disposable mains water, works as illustrated hereinbelow.

In the winter: the humidifying section 103 is automatically activated, as described in more detail hereinbelow, according to the booth humidity value requirement, for example set on the panel of the operator; in case of humidity in the booth that is below the set value, the control unit 40 opens the valve 114 (the on-off valve) for supplying water to the evaporation pack 112, allowing the adiabatic humidification of the air without absorption of external energy.

In the summer: if the value of humidity of outside air allows a further increase thereof without generating problems for the painting (usually the limit value is set at about 65%) and the temperature of the external air is greater than the set value that is set, the control unit 40 opens the on-off valve for supplying water to the evaporation pack 112, allowing the adiabatic humidification of the air without absorption of external energy up to the limit of 65% humidity.

This process generates a reduction of the temperature of the external air introduced into the booth, the extent whereof being directly linked to the values of the humidity of the air involved.

In order to be able to automatically manage the plant, the same is provided with at least one sensor 105 of a parameter linked to humidity in the painting booth, configured for sending to the control unit 40 a signal indicative of a humidity inside the painting booth 28.

The humidity sensor 105 can also be arranged in the plant where it is deemed most suitable for the purpose of the operation thereof. For example, the same can be found directly in the painting booth 28 so as to directly detect the value of humidity that is found in such setting, or it can be found along the direction of the delivery flow A downstream of the humidifying section 103. In addition, nothing prohibits the humidity sensor from being situated in the polluted air discharge conduit.

The humidifying means 104 and the sensor 105 are driven by the control unit 40, which in turn is programmed for receiving a set value or set range of values of the humidity inside the painting booth. The desired specific value (e.g. 40% humidity) or the set range of values (e.g. humidity between 35% and 40%) can be pre-stored in the memory of the control unit and suitably selected according to a specific procedure or even directly set by the operator and received by means of the data entering system of the control unit 40. The latter is configured for automatically controlling the humidity of the plant; in particular, the same control unit receives the signal indicative of the humidity inside the painting booth by means of the sensor 105 and adjusts the humidifying means 104 in a manner such that they introduce more or less humidity into the intake flow as a function of said set value or set range of values and of said humidity indicative signal inside the booth.

In fact, the control unit 40 commands the valve 114 to increase and/or decrease the fluid flow rate towards the adiabatic evaporation pack, and specifically is programmed for determining if there is a difference between the set value and a humidity inside the booth 28 which is respectively greater or less than a predetermined threshold, i.e. for establishing if it is necessary to increase the humidification or reduce the water supply (in order to meet the humidity requirement settings in the booth). Following such verification, the control unit 40 increases the fluid flow rate if the difference is greater than the threshold and/or decreases the fluid flow rate if the computed difference is less than the threshold.

It should be observed that the control unit 40, having also the temperature sensor 118, can control the humidifying means also based on such signal proportional to the temperature in the booth 28 or to the temperature of the air at the inlet.

Especially during the summer, it can occur that the air from the outside environment is at a rather high temperature and that therefore it may be desirable to cool the same before introducing it into the painting booth.

For this purpose, the humidifying means can be used for reducing the temperature by dispersing heat via the evaporation process that occurs during the passage of the air into the adiabatic evaporation pack.

This cooling system can also be controlled by adjusting the amount of water that reaches the panels, being careful however to not exceed specific humidity parameters in the booth (e.g. 65%) that can considerably reduce the performances of the painting plant.

For such purpose, once again, the temperature sensor 118 sends the detected temperature signal (temperature detected in the booth or in the flow at the inlet) to the control unit 40, which is programmed for receiving the set temperature value (or the range of desired values), determining the temperature inside the painting booth 28 (or in the air flow at the inlet), and commanding the humidifying means 104 as a function of the set temperature value and of the temperature value inside the booth (or in the air flow picked up from the outside environment before humidification).

In particular, the adjustment will occur as a function of the difference between the detected temperature and the desired temperature.

The control unit 40 once again commands the valve 114 to increase and/or decrease the fluid flow rate. In detail, the control unit 40 is programmed for determining if the difference between the set temperature value and the temperature inside the booth, determined by the signal coming from the temperature sensor, is respectively greater or less than a predetermined threshold (a significant difference—not a few degrees or tenths of degrees—is required in order to activate the humidity control system so as to avoid continuously actuating such system). Then, the control unit increases the fluid flow rate if the difference is positive and decreases the fluid flow rate if the difference is negative.

As mentioned above, in order to prevent overly high humidity values in the booth during the use of the humidifying means for obtaining a cooling, the control unit 40 is further programmed for determining if the humidity in the painting booth 28 is greater than or equal to a predetermined threshold (e.g. 65% relative humidity); in case the humidity in the painting booth (28) is greater than or equal to the predetermined threshold and in case the temperature inside the painting booth is greater than the set temperature value, the control unit 40 does not command any increase of the fluid flow rate, accepting a high, non-set temperature in the booth in order to avoid (in the case of active control) overly increasing the humidity in the booth.

Downstream of the humidifying section 103, the intake conduit 44 finally comprises a thrust section 106 provided with at least one ventilator 117 (particularly of centrifugal type) configured for generating an air flow towards the painting booth 28.

The thrust section 106 is situated downstream of the humidifying section 103 and of the heating section 101 along an advancement direction A of the intake air.

From this thrust section 106, the treated air is introduced (directly or by means of further suitable channels in accordance with the positioning of the treatment unit) in the painting booth.

The air extracted from the booth and intended for discharge is drawn as described above and crosses the discharge conduits until reaching the high-efficiency cross-flow static heat recovery system 108 with transfer of sensitive heat to the intake air at the inlet.

In particular, the air extraction thrust is ensured by a high-performance centrifugal ventilator placed downstream of the circuit, before the air expulsion channels.

It should be observed that the intake conduit 44 and the discharge conduit 46 can be placed in communication for specific operating modes of the plant. For such purpose, the intake conduit 44 comprises a by-pass passage 109 (see FIG. 7) for placing the intake conduit 44 in direct fluid communication with the polluted air discharge conduit 46.

A closure shutter 110 is also present that is adapted to selectively stop a fluid flow through the by-pass passage 109 and the control unit is active on the closure shutter 110 for selectively commanding the movement thereof from the closed condition to the open by-pass condition, particularly during a drying operative condition in painting booth.

The recycling section can also be manually activated by the operator panel, which by means of the abovementioned shutter allows the partial recycling of air. This option can in detail only be activated for the step of drying with hot air settable by board with maximum air temperature up to 60° C.

The painting plant 10 comprises a cable-carrier chain placed parallel to the conduits 44, 46. The cable-carrier chain connects the electrical plant on the edge of the booth 28 with the power grid of the building. The cable-carrier chain 64 can also connect the painting booth with tubes of compressed air or methane gas for supplying the heating arc. The painting booth 28 can also be equipped with a burner 66 fed with methane gas for heating the environment inside the painting booth 28.

During use, the vehicles V are positioned on the work stations 18, 20, 22 where the following operations take place: disassembly/reassembly, replacement of damaged body components, repair or replacement of mechanical components, etc. . . . . At the end of the repair operations, the vehicle is not moved from the work station 18, 20, 22 where it is situated. In order to carry out the painting operations, the painting booth 28 is moved in the direction A in order to position it on the work station 18, 20, 22 where the vehicle V is situated that must be subjected to the painting operations. During the translation of the booth 28, the doors 38 of the lateral walls 32 are raised. When the painting booth 28 is correctly positioned on the work station 18, 20 or 22, the painting booth 28 is locked and the doors 38 are lowered. The intake mouth 58 of the painting booth 28 is connected to the intake conduit 44 by means of the opening 56 facing the intake mouth 58. In particular, the pneumatic gaskets 60 fed with compressed air present in the booth, placed below the perimeter walls of the booth, are inflated, allowing the sealing closure between the booth itself and the floor and preventing the outflow of painting fumes and powders; vice versa, still with automatic sequence, the pneumatic gaskets are deflated, unlocking the booth from the work position at the end of the cycle when the operator must translate the booth into another work position. The fresh air delivery ventilator 62 of the painting booth 28 suctions a fresh air flow from outside the building and distributes it inside the painting booth 28. Simultaneously, the discharge ventilator 55 of the intake/discharge group 50 suctions a polluted air flow through the floor of the platform 16 and sends it outside through the external expulsion conduit 52. In the painting booth 28, the painting and drying operations are carried out in a setting that is insulated from the building interior, without risks of contaminating the building interior with paints sprayed inside the booth 28. Inside the painting booth 28, a top-to-bottom circulation is carried out of the fresh air flow, with a complete removal of the paints suspended in the air.

The painting plant according to the present invention eliminates the displacements and movements of the vehicles inside the body-shop during all the repair steps. The vehicles, once positioned in the work station assigned at the start of the cycle, will not be moved until the end of the operations. This also allows a reduction of the number of the painting booths installed in a body-shop with respect to the conventional plants with stationary painting booths.

The advantages offered by the direct heating system with humidification of the delivery air in the booth are numerous.

Indeed, the direct fire burner allows a clear reduction of the making-operative times of the plant with respect to the indirect systems with boiler and even a greater temperature precision and stability with respect to the set value that has been set. It is possible to eliminate the service stacks for removing combustion fumes.

The humidification of the air with the above-described method and configuration allow a clear applicability and sprayability of the latest-generation water-based products, which offer the best outputs with the humidity of the air in a range between 30% and 60%.

In winter, with outside temperatures below about 5° C., the only heating of the air provided in conventional systems brings the humidity of the air introduced into the booth to very low values, on the order of 10-15%—not very compatible with the application of the latest-generation painting products. This does not occur in the system as described herein. Finally, the treatment unit allows a considerable reduction of the formation of static currents inside the booth, of which the main catalyst is the low level of humidity of the air (when below 30% humidity). The value of humidity lower than 30% is regularly reached in the winter if the air heating system does not provide for the humidification of air to higher values. The summer cooling of the air introduced into the booth is not to be forgotten—actually this is free, exploiting the physical principle of adiabatic cooling obtained with feeding of mains water to the evaporating pack and reduction of the temperature. The system is particularly effective in the presence of summer climates characterized by high temperatures and low humidity of the air.

Naturally, without prejudice to the principle of the invention, the structural details and the embodiments can be extensively varied with respect to that described and illustrated without departing from the scope of the invention, as defined by the following claims.

The invention claimed is:

1. A painting plant comprising:

a painting booth (28) defining inside a work environment closed under operative conditions, an air admitting and extracting system (42) associated with the painting booth (28), a programmable control unit (40) associated with the painting booth and provided with a data entering system (40*a*) and a data storing memory; and at least one sensor (105) of a parameter linked to humidity in the painting booth, configured for sending to the programmable control unit (40) a signal indicating a humidity inside the painting booth (28); said air admitting and extracting system (42) comprising at least one fresh air intake conduit (44) having an inlet for withdrawing air from an external environment and an outlet for admitting air in the painting booth (28) and at least one polluted air discharge conduit (46) having a respective inlet for taking away polluted air from the painting booth, said air intake (44) and air discharge (46) conduits being stationary and both communicating with an external environment under operative conditions of the painting booth, wherein the intake conduit (44) comprises:

a heating section (101) having a heater (102) for heating the air to be delivered to the painting booth (28); and a humidifying section (103) having means (104) for humidifying the air to be delivered to the painting booth (28);

a by-pass passage (109) for communicating the intake conduit (44) with the polluted air discharge conduit (46); and a closure shutter (110) to selectively stop a fluid flow through the by-pass passage (109), the programmable control unit being active on the closure shutter (110):

the programmable control unit (40) being active on the humidifying means (104) and on said at least one sensor (105) and programmed for:

receiving a set value or a set range of values of the humidity inside the painting booth, said set value or set range of values being pre-stored in the memory of the programmable control unit, or being received by the data entering system;

receiving the signal indicative of a humidity inside the painting booth from the sensor (105);

adjusting the humidifying means (104) as a function of said set value or set range of values and of said humidity indicative signal;

wherein the programmable control unit is further programmed to selectively command a movement of the closure shutter (110) during a drying operative condition in the painting booth from a closed condition with no fluid flow through the by-pass passage (109) to an open by-pass condition with a fluid flow through the by-pass passage (109).

2. The painting plant according to claim 1, wherein the humidifying means (104) comprises a predetermined number of evaporating panels (112) arranged in the humidifying section substantially transverse to the intake air flow direction, the intake air crossing said predetermined number of evaporating panels (112) and being humidified, the humidifying means (104) further comprises a transport line (113) for a fluid adapted to wet the evaporating panels and a valve (114) for adjusting the fluid flow rate towards the evaporating panels (112).

3. The painting plant according to claim 2, wherein the humidifying means (104) comprises at least one condensate and water drops abatement element (115) and a condensate and water drops collection tank (116) placed below said abatement element (115).

4. The painting plant according to claim 2, wherein the control unit (40) commands said valve (114) to increase or decrease the inlet fluid flow rate, the control unit (40) being programmed for:

determining if a difference between the set value and a humidity inside the booth (28), determined by the signal coming from the sensor (105), is respectively greater or less than a predetermined threshold;

increasing the inlet fluid flow rate if the difference is greater than the threshold;

decreasing the inlet fluid flow rate if the difference is greater than the threshold.

5. The painting plant according to claim 1, wherein the intake conduit (44) further comprises a thrust section (106) having at least one ventilator (117) configured for generating an air flow towards the painting booth (28), said thrust section (106) being placed downstream of said humidifying section (103) and of said heating section (101) along an advancement direction (A) of the intake air, the humidifying section (103) being placed downstream of the heating section (101) along an advancement direction (A) of the intake air.

6. The painting plant according to claim 1, wherein further comprising at least one temperature sensor (118) for supplying a signal indicative of the temperature inside the painting booth (28), the temperature sensor (118) being connected to the control unit (40), the control unit being configured for:

receiving a set temperature value;

determining a temperature inside the painting booth (28);

commanding the humidifying means (104) as a function of the difference between said set temperature value and of said temperature value inside the booth.

7. The painting plant according to claim 6, wherein the humidifying means (104) comprises a predetermined number of evaporating panels (112) arranged in the humidifying section substantially transverse to the intake air flow direction, the intake air crossing said predetermined number of evaporating panels (112) and being humidified, the humidifying means (104) further comprises a transport line (113) for a fluid adapted to wet the evaporating panels and a valve (114) for adjusting the fluid flow rate towards the evaporating panels (112), and wherein the control unit (40) commands said valve (114) to increase or decrease the fluid flow rate, the control unit (40) being programmed for:

determining if a difference between the set temperature value and the temperature inside the booth, determined by the signal coming from the temperature sensor, is respectively greater or less than a predetermined threshold;

increasing the fluid flow rate if the difference is greater than the threshold;

decreasing the fluid flow rate if the difference is greater than the threshold, the control unit (40) being further programmed for determining if the humidity in the painting booth (28) is greater than or equal to a predetermined threshold, in case the humidity in the painting booth (28) is greater than or equal to the predetermined threshold and in case the temperature inside the painting booth is greater than the set temperature value, the control unit (40) does not command any increasing of the fluid flow rate.

8. The painting plant according to claim 1, wherein the intake conduit (44) comprises an intake air pre-filtration assembly (107), said pre-filtration assembly (107) being placed downstream of the inlet to the intake conduit (44) and upstream of the heating section (101) along an advancement direction of the intake air, the intake conduit (44) further comprising a heat exchanger (108), said heat exchanger (108) being placed upstream of the heating section (101) along an advancement direction of the intake air, said heat exchanger (108) exchanging heat with the polluted air exiting the painting booth (28).

9. The painting plant according to claim 1, comprising a platform (16) on which a plurality of work stations (18, 20, 22) are defined, each of which adapted to receive a vehicle (V), the painting booth (28) being movable on the platform (16) and positionable on each of said work stations (18, 20, 22), wherein the polluted air discharge conduit (46) communicates with air intake volumes (48) placed below said platform (16), wherein said fresh air intake conduit (44) has a plurality of openings (56) placed at respective work stations (18, 20, 22), and wherein the intake booth (28) comprises a fresh air intake vent (58) selectively connectable to the opening (56) placed at the work station (18, 20, 22) on which the painting booth (28) is positioned, said intake mouth (58) being provided with a front seal (60) adapted to establish a sealing contact with a front wall of the fresh air intake conduit (44) around the corresponding opening (56).

10. The painting plant according to claim 9, wherein the front seal (60) has a pressurizable cavity for moving the front seal (60) between a sealed position and a disengaged position.

11. The painting plant according to claim 1, further comprising:

a drying system housed inside the painting booth (28);

at least one air inflow paint gun housed inside the painting booth (28), wherein the air inflow to the paint gun is interrupted under an activation condition of the drying system.

12. The painting plant according to claim 11, wherein said drying system is an infrared radiation technology semi-arc drying system.

13. A painting plant comprising:

a painting booth (28) defining inside a work environment closed under operative conditions, an air admitting and extracting system (42) associated with the painting booth (28), a programmable control unit (40) associated with the painting booth and provided with a data entering system (40*a*) and a data storing memory;

at least one temperature sensor (118) for supplying a signal indicative of the temperature inside the painting booth (28), the temperature sensor (118) being connected to the programmable control unit (40), at least one sensor (105) of a parameter linked to humidity in the painting booth, configured for sending to the programmable control unit (40) a signal indicating a humidity inside the painting booth (28); said air admitting and extracting system (42) comprising at least one fresh air intake conduit (44) having an inlet for withdrawing air from an external environment and an outlet for admitting air in the painting booth (28) and at least one polluted air discharge conduit (46) having a respective inlet for taking away polluted air from the painting booth, said air intake (44) and air discharge (46) conduits being stationary and both communicating with an external environment under operative conditions of the painting booth, wherein the intake conduit (44) comprises:

a heating section (101) having a heater (102) for heating the air to be delivered to the painting booth (28); and a humidifying section (103) having means (104) for humidifying the air to be delivered to the painting booth (28), the humidifying means (104) comprises a predetermined number of evaporating panels (112) arranged in the humidifying section substantially transverse to the intake air flow direction, the intake air crossing said predetermined number of evaporating panels (112) and being humidified, the humidifying means (104) further comprises a transport line (113) for a fluid adapted to wet the evaporating panels and a valve (114) for adjusting the fluid flow rate towards the evaporating panels (112);

the programmable control unit (40) being active on the humidifying means (104) and on said at least one sensor (105) and programmed for:

receiving a set value or a set range of values of the humidity inside the painting booth, said set value or set range of values being pre-stored in the memory of the programmable control unit, or being received by the data entering system;

receiving the signal indicative of a humidity inside the painting booth from the sensor (105); and adjusting the humidifying means (104) as a function of said set value or set range of values and of said humidity indicative signal, wherein the programmable control unit (40) is further active on the humidifying means (104) and on said at least one temperature sensor (118) and programmed for:

receiving a set temperature value;

determining a temperature inside the painting booth (28);

calculating a temperature difference between the temperature value inside the booth and the set temperature value;

determining if the temperature difference is respectively greater or less than a predetermined temperature difference threshold; and increasing the inlet fluid flow rate if the temperature difference is greater than the temperature difference threshold;

the programmable control unit (40) being further programmed for determining if the humidity in the painting booth (28) is greater than or equal to a predetermined humidity threshold, in case the humidity in the painting booth (28) is greater than or equal to the predetermined humidity threshold and in case the temperature inside the painting booth is greater than the set temperature value, the programmable control unit (40) being configured to stop increasing of the inlet fluid flow rate.

14. The painting plant according to claim 13, wherein the control unit (40) commands said valve (114) to increase or decrease the inlet fluid flow rate.

15. The painting plant according to claim 13, wherein the intake conduit (44) further comprises a thrust section (106) having at least one ventilator (117) configured for generating an air flow towards the painting booth (28), said thrust section (106) being placed downstream of said humidifying section (103) and of said heating section (101) along an advancement direction (A) of the intake air, the humidifying section (103) being placed downstream of the heating section (101) along an advancement direction (A) of the intake air.

16. The painting plant according to claim 13, wherein further comprising, the control unit being programmed to:

commanding the humidifying means (104) as a function of the difference between said set temperature value and of said temperature value inside the booth.

17. The painting plant according to claim 13, further comprising:

a driving system housed inside the painting booth (28);

at least one air inflow paint gun housed inside the painting booth (28), wherein the air inflow to the paint gun is interrupted under an activation condition of the drying system.

18. The painting plant according to claim 13, wherein the intake conduit (44) comprises a by-pass passage (109) for communicating the intake conduit (44) with the polluted air discharge conduit (46) and further comprises a closure shutter (110) adapted to selectively stop a fluid flow through the by-pass passage (109), the control unit being active on the closure shutter (110) for selectively commanding the movement thereof from the closed condition to the open by-pass condition.

19. The painting plant according to claim 13, comprising a platform (16) on which a plurality of work stations (18, 20, 22) are defined, each of which adapted to receive a vehicle (V), the painting booth (28) being movable on the platform (16) and positionable on each of said work stations (18, 20, 22), wherein the polluted air discharge conduit (46) communicates with air intake volumes (48) placed below said platform (16), wherein said fresh air intake conduit (44) has a plurality of openings (56) placed at respective work stations (18, 20, 22), and wherein the intake booth (28) comprises a fresh air intake vent (58) selectively connectable to the opening (56) placed at the work station (18, 20, 22) on which the painting booth (28) is positioned, said intake mouth (58) being provided with a front seal (60) adapted to establish a sealing contact with a front wall of the fresh air intake conduit (44) around the corresponding opening (56).

20. The painting plant according to claim 1, wherein the by-pass passage (109) is placed upstream the heating section (101) to cause recirculating air to pass through the heating section (101).

* * * * *